US005655932A

United States Patent [19]

Breitschaft et al.

[11] Patent Number: 5,655,932

[45] Date of Patent: Aug. 12, 1997

[54] FILTER PLUG CONNECTOR HAVING A SHIELD HOUSING

[75] Inventors: Josef Breitschaft, Prien; Ernst Liebich, Geltendorf; Karl Schneider, München; Josef Dirmeyer, Bodenwöhr; Egbert Wagner, Barbing, all of Germany; Peter Moerkerke, Oostende, Belgium

[73] Assignee: Siemens Aktiengesellschaft, Munich, Germany

[21] Appl. No.: 365,693

[22] Filed: Dec. 29, 1994

Related U.S. Application Data

[63] Continuation of PCT/DE93/00494, Jun. 8, 1993.

[30] Foreign Application Priority Data

Jun. 29, 1992 [DE] Germany ..... 9208702 U

[51] Int. Cl.[6] ..... H01R 13/66

[52] U.S. Cl. ..... 439/620; 439/607; 439/939

[58] Field of Search ..... 439/607–610, 439/620, 95, 101

[56] References Cited

U.S. PATENT DOCUMENTS

| | | | |
|---|---|---|---|
| 4,863,401 | 9/1989 | Talend | 439/610 |
| 4,954,097 | 9/1990 | Sekiguchi | 439/610 |
| 5,160,273 | 11/1992 | Carney | 439/608 |
| 5,171,161 | 12/1992 | Kachlic | 439/610 |
| 5,232,380 | 8/1993 | Inoue et al. | 439/610 |
| 5,246,387 | 9/1993 | Liebich et al. | 439/620 |
| 5,281,170 | 1/1994 | Murphy | 439/610 |

FOREIGN PATENT DOCUMENTS 9005597 10/1991 Germany .

*Primary Examiner*—David L. Pirlot
*Assistant Examiner*—Brian J. Biggi
*Attorney, Agent, or Firm*—Herbert L. Lerner; Laurence A. Greenberg

[57] ABSTRACT

In order to provide a simple connection between a shield housing and a strip body, the shield housing has resilient side parts with spring arms being initially bent inwards and then outwards and being pushed over lead-in and sliding inclines on the strip body and automatically latched on an insertion side or front of the strip body. Those sections of the spring arms which are bent outwards form contact elements for the shield housing to make contact on a mounting panel. The invention is suitable for motor vehicle filter plug connectors.

14 Claims, 4 Drawing Sheets

FILTER PLUG CONNECTOR HAVING A SHIELD HOUSING

CROSS-REFERENCE TO RELATED APPLICATION

This application is a Continuation of International Application Serial No. PCT/DE93/00494 filed Jun. 8, 1993.

BACKGROUND OF THE INVENTION

Field of the Invention

The invention relates to a filter plug connector having a strip body of insulating material forming a chamber being open to the rear for a ferrite core configuration, a number of parallel plug pins being disposed in a grid, entering the chamber from the rear and emerging through a base of the chamber to a front of the strip body, at least some of the plug pins being guided in the chamber by holes in the ferrite core configuration, a shield housing covering side walls and at least part of the rear of the strip body and of the chamber and having a cut out for the plug pins, the shield housing having resilient or sprung side parts engaging over the side walls of the strip body and having bends on its side parts being latched onto latching devices on the front of the strip body, and a capacitive filter element for a number of the plug pins, the filter element being soldered to the plug pins on one hand and to the shield housing on the other hand, on the outside of the shield housing opposite the rear of the chamber.

Such a filter plug connector is disclosed in German Utility Model DE-GM 90 05 597. In the case of that plug connector, the shield housing is fastened to the strip body through sprung side parts which engage over the side walls of the strip body and latch on its front by means of bent edge sections. In that case, once the shield housing has been pushed onto the strip body, the edge sections are bent inwards and latched in a single operation. In addition, spring arms which are integrally formed run on the edge sections along the side walls of the strip body, are bent away from the strip body and produce a contact and a ground connection without any additional measures during installation of the plug connector on a mounting panel. In that way, fastening of the shield housing is achieved in the case of the known plug connector. The fastening can generally be used well with a ground connection which can be produced at the same time as the installation. However, under certain circumstances, for example if the negative tolerances in the thickness of a mounting panel are exceeded, the shield contact, which is intrinsically reliable, may be unfavorably influenced.

SUMMARY OF THE INVENTION

It is accordingly an object of the invention to provide a filter plug connector having a shield housing, which overcomes the hereinafore-mentioned disadvantages of the hereto-fore-known devices of this general type and which achieves even more cost-effective fastening of the shielded housing and increased reliability of the screen contact.

With the foregoing and other objects in view there is provided, in accordance with the invention, a filter plug connector, comprising a strip body being formed of insulating material and having a front with latching devices, a rear and side walls; a ferrite core configuration having holes formed therein; a chamber being formed by the strip body, having an open rear for receiving the ferrite core configuration and having a base; a number of parallel plug pins being disposed in a grid, entering the chamber from the rear and emerging through the base of the chamber to the front of the strip body, at least some of the plug pins being guided in the chamber by the holes in the ferrite core configuration; a shield housing covering the side walls and at least part of the rear of the strip body and of the chamber, the shield housing having a cut out formed therein for the plug pins, having resilient side parts engaging over the side walls of the strip body, having bends on the side parts latching onto the latching devices on the front of the strip body, and having an outer surface; a capacitive filter element for receiving a number of the plug pins, the filter element being soldered to the plug pins and to the shield housing at the outer surface of the shield housing opposite the rear of the chamber; the bends on the resilient side parts of the shield housing being mutually separate and mutually parallel individual spring arms, the spring arms having a section being bent inwards from the side parts approximately at right angles and a section being bent outwards from the inward bent section at an angle less than 180° to form a radius, the inward bent section forming a sliding and latching element, and the outward bent section forming a contact element for the shield housing to make contact with a mounting panel; and the side walls of the strip body being tapered towards the open rear of the chamber at least over a subregion extending in a plugging direction, forming lead-in and sliding inclines for the sliding and latching element to expand the side parts of the shield housing during connection of the shield housing and the strip body, and at least one of the sliding and latching elements having a latching device in the vicinity of the inward bent section for automatically latching the at least one sliding and latching element on the latching devices on the front of the strip body, with the latching device springing inwards after passing over the side walls of the strip body.

In the case of the shield housing of such a filter plug connector, the bends of the sprung side parts are constructed as spring arms which are initially bent inwards and are then bent outwards again, the section of the spring arms which is bent inwards forms a sliding and latching element for the shield housing to be plugged and latched on the strip body, and the section of the spring arms which is bent outwards forms a contact element for the shield housing to make contact with a mounting panel. In addition, the strip body is constructed with lead-in and sliding inclines. When a shield housing is plugged onto a strip body or the strip body is inserted into a shield housing, the radii of the sliding and latching elements of the spring arms run onto the lead-in and sliding inclines, as a result of which the sprung side parts of the shield housing are automatically expanded without any aids. After passing over the side surfaces of the strip body, that is to say when the sliding and latching elements of the spring arms are pushed over an end edge of the side surfaces on the front of the strip body, the side parts of the shield housing, and thus the sliding and latching elements, spring inwards again, with their latching device automatically latching on the latching devices on the front of the strip body. In consequence, in the case of the filter plug connector according to the invention, the shield housing is fixed on the strip body by self-latching and without any dedicated operation, as a result of which even more cost-effective fastening of the shield housing is achieved. The contact element of the spring arms which is bent outwards is directly connected to the radius of the sliding and latching element, so that the contact element is the same width on its spring base as the sliding and latching element and thus has a larger spring base than the relatively narrow spring or contact tongues, which results in a greater contact force. Since the contact element starts internally on the radius and is bent outwards from there, it can now also be constructed in such a way as to be larger in its longitudinal extent, as a result of which a spring arm is produced which is longer overall and has a longer spring movement. In interaction with a greater contact force, which is achieved by the broader spring base, this longer spring movement leads to an increase in the reliability of contact making, so that a reliable shield contact is ensured which is more independent of tolerances, even in the event of unfavorable tolerance relationships in the thickness of a mounting panel.

In accordance with another feature of the invention, the shield housing is a bent sheet-metal part being bent to be ready for use and ready for insertion.

In accordance with a further feature of the invention, the side parts of the shield housing are mutually opposite, and an equal or different number of the spring arms are disposed on the mutually opposite side parts and are aligned with one another.

In accordance with an added feature of the invention, the contact elements of the spring arms are longer than the sliding and latching elements.

In accordance with again another feature of the invention, the contact elements of the spring arms are domed in the region of their free end. This is advantageous with respect to contact reliability of a contact element and it results in a minimized contact area and thus a high specific contact force.

In accordance with again a further feature of the invention, in order to provide a particularly simple, cost-effective and reliable retention both of the ferrite core configuration and of the filter element, a base surface of the shield housing which covers the open chamber of the strip body is provided with a centrally disposed, rectangular cut out with mutually parallel webs and pointed bars which are disposed on two mutually opposite longitudinal sides and initially lie in a plane and are directed towards one another in the developed projection of the shield housing.

In accordance with again an added feature of the invention, the webs for retention of the ferrite core configuration are bent inwards in such a way that they are inclined with respect to the base surface, and the pointed bars are bent outwards, at right angles to the base surface, for the filter element to be plugged onto. As a result of the springing effect of the webs, it is possible to ensure that the ferrite core configuration is fastened in the chamber in the strip body without any play. The configuration of the pointed bars allows the filter element to be fastened in a manner which is convenient for assembly.

In accordance with again an additional feature of the invention, in order to assist the latching of the shield housing on the strip body, there are provided other spring arms which are disposed symmetrically with respect to the center of the base surface, are drawn out of the base surface of the shield housing which covers the open chamber of the strip body and are bent inwards in such a way that they are inclined with respect to the base surface. These spring arms act against the insertion direction of the strip body and thus lead to secure latching of the shield housing.

In accordance with yet another feature of the invention, in order to match the strip body to the shield housing, the side walls of the strip body in each case have a dedicated lead-in and a sliding incline for each spring arm of the shield housing.

In accordance with yet a further feature of the invention, the side walls of the strip body have a given extent as seen in the plugging direction, and the side walls have the lead-in and sliding inclines over approximately two thirds of the given extent and have straight surfaces being parallel to the plugging direction over approximately one third of the given extent.

In accordance with yet an added feature of the invention, the latching device of the sliding and latching elements is a latching hole, and the latching devices on the front of the strip body are projections.

In accordance with yet an additional feature of the invention, the latching devices include a dedicated latching device for each respective sliding and latching element of the spring arms being disposed on the front of the strip body.

In accordance with a concomitant feature of the invention, in order to provide further cost optimization in the case of a filter plug connector according to the invention, the filter element is constructed on a printed circuit board base material. Such a printed circuit board filter is more cost effective than a planar filter with a ceramic substrate and, as a result of the capability of fastening it in an advantageous manner on the shield housing, it can be installed more easily from the rear of the strip body or on its connection side.

Other features which are considered as characteristic for the invention are set forth in the appended claims.

Although the invention is illustrated and described herein as embodied in a filter plug connector having a shield housing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 7:
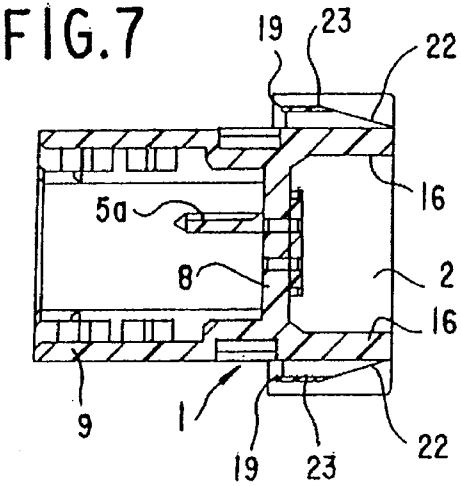

Referring now to the figures of the drawing in detail and first, particularly, to FIGS. 1 to 4 thereof, there is seen a filter plug connector which has a strip body 1 that is formed of insulating material, for example of plastic, and is illustrated in detail in FIGS. 5 to 8. The strip body 1 has side walls 16 which form a chamber 2 that is best seen in FIG. 7 and is open towards the connection side or rear, for accommodating a ferrite core configuration having a ferrite core 3*a* seen in FIG. 4. The chamber 2 is closed by a shield housing 4, which is shown in detail in FIGS. 9 to 12. The strip body 1 furthermore has a number of parallel plug pins 5 which are disposed in a grid, which enter the chamber 2 from the connection side through holes 15 in a filter element 6 seen in FIG. 2 and a cut out 7 in the shield housing 4 and which are passed through a base 8 of the chamber seen in FIG. 7 to the insertion side or front of the filter plug connector, where they form free plug ends 5*a* for connection to a plug socket. The free plug ends 5*a* are surrounded by a collar 9 which is integrally formed on the strip body 1 and has latching elements 10 on its outside for latching on a mounting panel 11, for example a front panel of a piece of equipment. On the connection side or rear, sections 5*b* of the plug pins 5 are bent approximately at right angles and are soldered to a circuit board 12 seen in FIG. 3.

Figure 3:
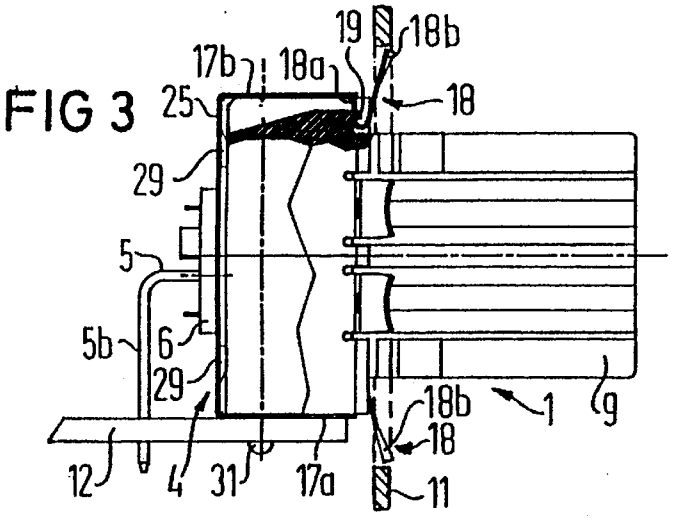
FIGS. 3 and 4 are side-elevational views of the filter plug connector.
Figure 2:
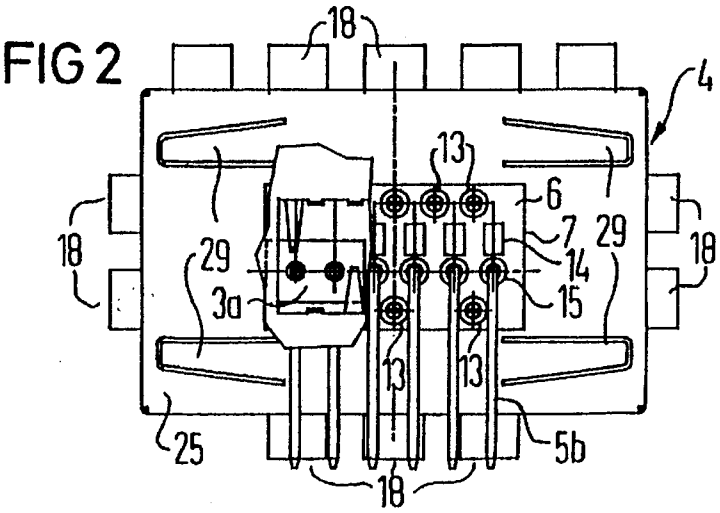
FIGS. 1 and 2 are diagrammatic plan views of a filter plug connector, namely of an insertion side or front in FIG. 1 and of a connection side or rear in FIG. 2.
Figure 1:
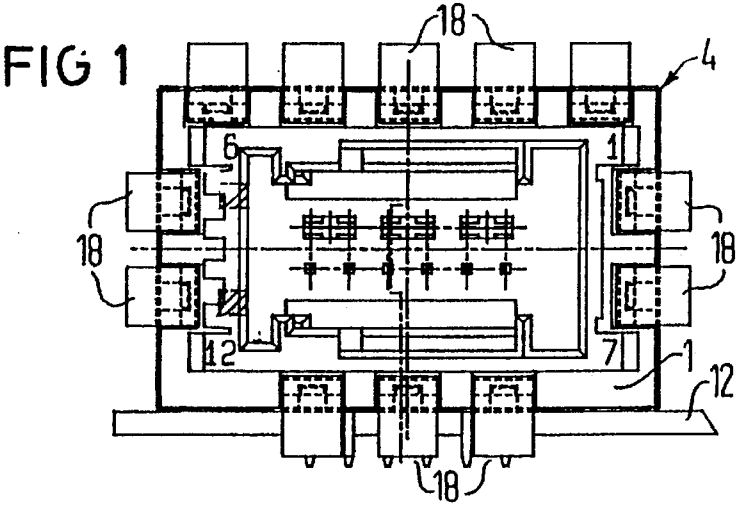
Figure 4:
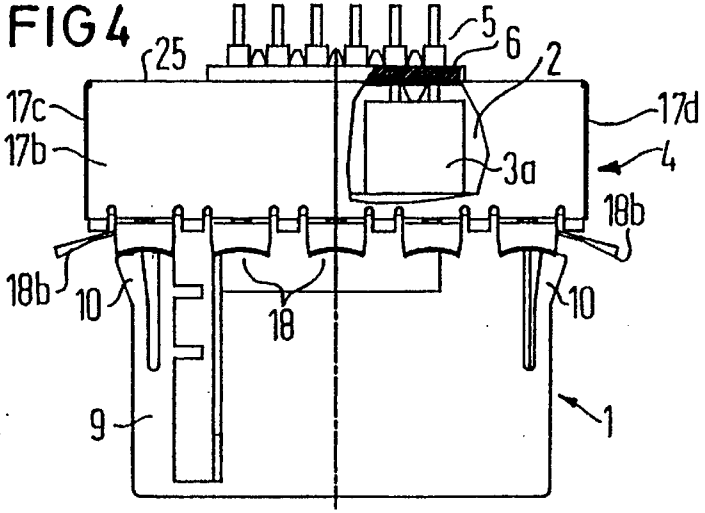
Figure 6:
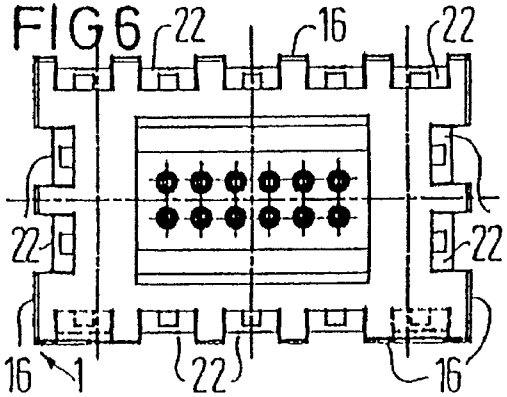
FIGS. 5 and 6 are plan views of a strip body, which is part of the filter plug connector and is fitted with plug pins, namely of the insertion side in FIG. 5 and of the connection side in FIG. 6.
Figure 5:
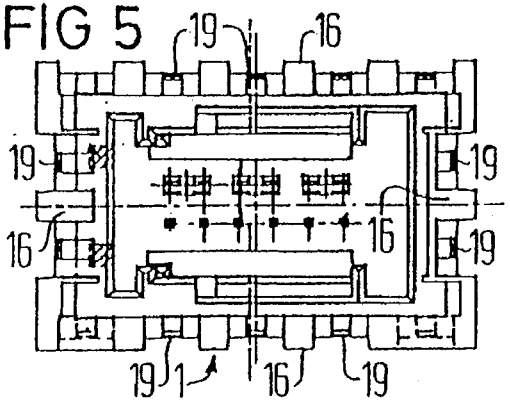
Figure 8:
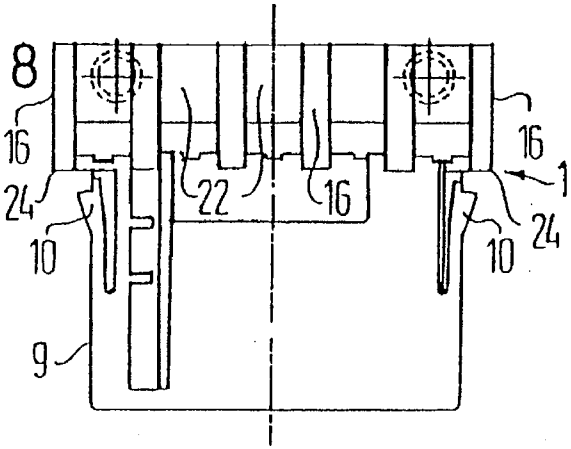
FIGS. 7 and 8 are side-elevational views of the strip body according to FIGS. 5 and 6, with FIG. 7 showing a section illustration.

The ferrite core configuration which is accommodated in the chamber 2 has holes in the grid of the plug pins. Through the use of these holes, the ferrite core 3*a* is plugged onto the plug pins 5. If only some of the plug pins, for example two plug pins or a row or group of six plug pins, of a 12-pole filter plug connector are intended to be provided with filter elements, the ferrite core 3*a* of the ferrite core configuration may, for example, be a 2-hole ferrite core 3*a* which is best seen in FIGS. 2 and 4 or a 6-hole ferrite core and may then be plugged only onto two plug pins or a row or group of six plug pins. The retention of the ferrite core configuration 3 without any play in the chamber 2 in the strip body 1 is also explained below, in conjunction with the shield housing.

The filter element 6 shown in FIG. 2 is constructed on a printed circuit board base material, is disposed on the connection side or rear of the shield housing 4, is provided with two mutually opposite rows having a different number of holes 13 for ground contact, has a row of capacitors 14 which are disposed between these two rows and which are fitted by using the SMD technique, and has a further row of the holes 15 for the plug pins 5.

The shield housing seen in FIGS. 9 to 12 includes a bent sheet-metal part which is bent in such a way that it is ready for use and is ready for plug insertion and covers the side walls 16 and at least part of the connection side or rear of the strip body 1 and of the chamber 2, with a cut out for the plug pins 5. The shield housing 4, which is bent out of a developed projection 4*a* of the bent sheet-metal part seen in FIG. 12 to form a rectangular trough, has resilient or sprung side parts 17*a* to 17*d* which engage over the side walls 16 of the strip body 1, and latch with bends onto projections 19 on the insertion side or front of the strip body. The bends on the sprung side parts 17*a* to 17*d* of the shield housing 4 are constructed as individual spring arms 18 which are separated from one another, are parallel to one another and in each case the same number or a different number are disposed and aligned with respect to one another on the respective mutually opposite side parts 17*a* and 17*b*, and 17*c* and 17*d*. Thus, the side parts 17*a* and 17*b* each have five spring arms 18 on the longitudinal side of the shield housing 4. The two outer spring arms of these spring arms 18, for example on the longitudinal side 17*a*, which are drawn in broken lines in FIG. 12, can be omitted, as can be seen in the case of the filter plug connector in FIGS. 1 and 2. The side parts 17*c* and 17*d* on the narrow side of the shield housing 4 are each constructed with two spring arms 18 which, for example as a result of the installation conditions, may be shorter than the spring arms provided on the longitudinal sides. The spring arms 18 are initially bent inwards from the side parts 17*a* to 17*d* approximately at right angles and are then bent outwards again to form a radius 20 at an angle of somewhat less than 180°. That section of the spring arms 18 which is bent inwards forms a sliding and latching element 18*a*. At a location close to the bend from the side parts 17*a* to 17*d*, the element 18*a* is provided with a latching device in the form of a hole 21 for the shield housing to latch on the individual projections or latching devices 19 on the strip body 1. The section of the spring arms 18 which is bent outwards forms a contact element 18*b* for the shield housing to make contact on the mounting panel 11. The contact elements 18*b*, which are directed in such a way that they are somewhat inclined with respect to the insertion direction of the strip body, are longer than the sliding and latching elements 18*a* and are domed in the region of their free ends.

As is seen in FIG. 7, the side walls 16 of the strip body 1 are tapered towards the open connection side or rear of the chamber 2, at least over a subregion which extends in the insertion direction, in such a manner that lead-in and sliding inclines 22 for the sliding and latching elements 18*a* of the spring arms are formed, in order to expand the sprung side parts 17*a* to 17*d* of the shield housing. In this case, the side walls 16 of the strip body 1 are in each case provided with a dedicated lead-in and sliding incline 22 for each spring arm 18 of the shield housing which is matched to the construction of the shield housing 4. These lead-in and sliding inclines are separated from one another corresponding to the mutual separation between the spring arms 18 of the shield housing 4. As is seen in the insertion direction in each case, the side walls 16 of the strip body 1 are constructed with the lead-in and sliding inclines 22 over approximately two thirds of their extent and with straight surfaces 23, which are parallel to the insertion direction, over approximately one third of their extent. These straight surfaces extend as far as edges 24 on the insertion side or front of the strip body 1.

Figure 9:
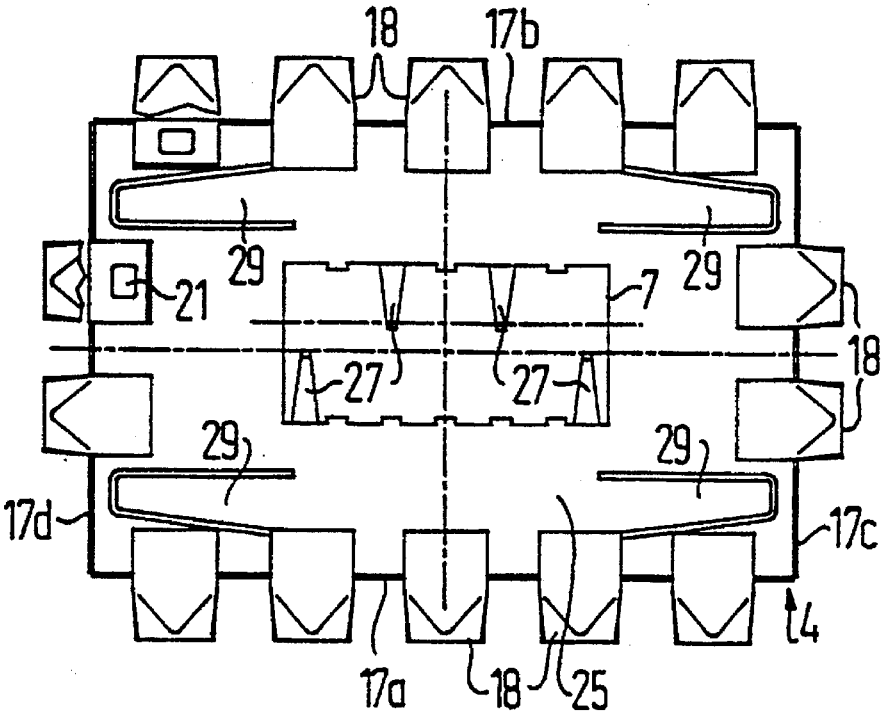
FIGS. 9, 10 and 11 are three views of a shield housing.
Figure 10:
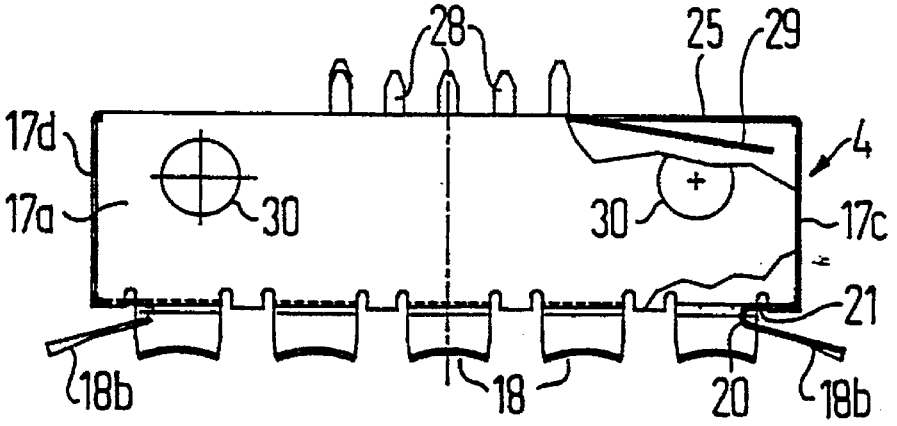
Figure 11:
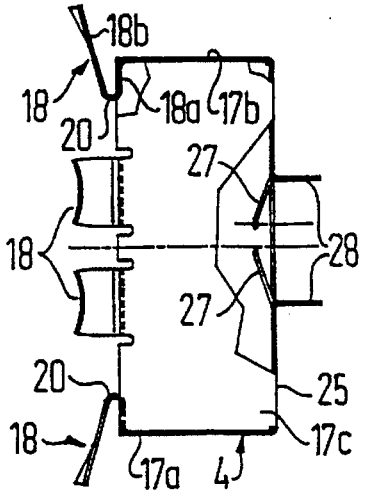
Figure 12:
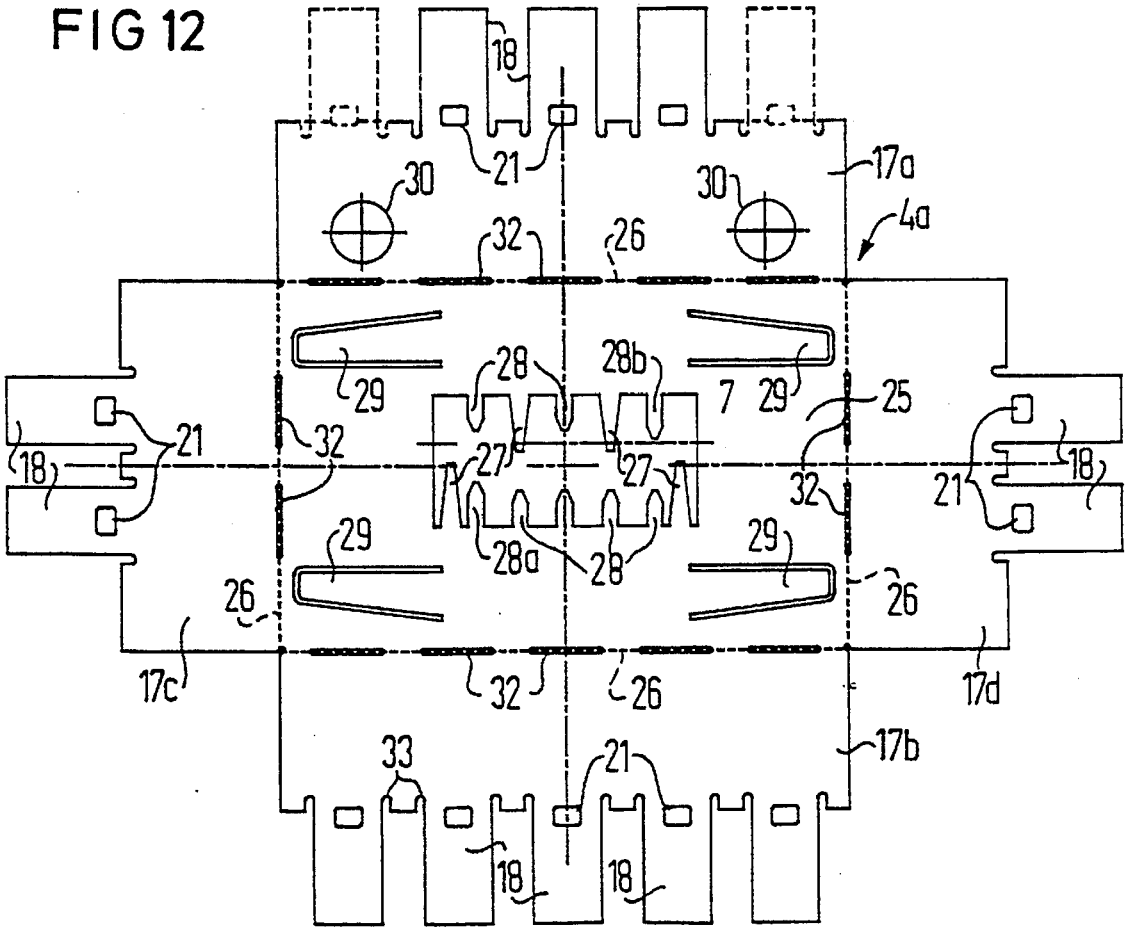
FIG. 12 is a developed projection of the shield housing, which includes a bent sheet-metal part.

Furthermore, the shield housing 4 is also constructed in a manner which is advantageous for passing the plug pins 5 through and for retention of the filter element 6 and of the ferrite core 3*a* of the ferrite core configuration. To that end, a base surface 25 of the shield housing 4 which covers the open chamber 2 in the strip body 1 is provided with the centrally disposed rectangular cut out 7 which has mutually parallel webs 27 and pointed bars 28 on two mutually opposite longitudinal sides. The webs 27 and the pointed bars 28 initially lie in a plane and are directed towards one another, in the developed projection of the shield housing seen in FIG. 12. The webs 27, which are tapered in a wedge shape, are bent inwards in such a way that they run obliquely with respect to the base surface 25, for retention of the ferrite core configuration, as can be seen in FIGS. 9 and 11, so that they press the ferrite core configuration in a sprung manner against the base 8 of the chamber 2. In contrast, the pointed bars 28 for plugging on the filter element 6, which are somewhat shorter than the webs, are bent outwards, at right angles to the base surface 25. Mutually diagonally opposite outer pointed bars 28*a* and 28*b* are somewhat longer than the other pointed bars 28 and, once the filter element 6 has been plugged on, are bent around in order to fix the filter element 6 temporarily until the soldering process. Finally, other spring arms 29 which are disposed symmetrically with respect to the center of the base surface are drawn out of the base surface 25 of the shield housing 4 which covers the open chamber 2 in the strip body 1, and are bent inwards in such a way that they are inclined with respect to the base surface 25. It is possible to see in FIGS. 9 and 12 that these spring arms 29 run, in the longitudinal direction, essentially parallel to the side parts 17*a* and 17*b*. The spring arms 29 are used for automatically latching the shield housing 4 on the strip body 1.

For reasons of completeness, it is added that the side part 17*a* of the shield housing 4 has two circular holes 30 for fastening rivets 31 that fasten the filter plug connector on the circuit board 12. Narrow longitudinal slots 32 are provided in bending edges 26 of the side parts 17*a* to 17*d*, and small incisions 33 are provided in the side parts 17*a* to 17*d*, laterally with respect to the spring arms 18, as bending aids.

During assembly of the plug connector, the filter element 6 is initially temporarily mounted on the shield housing 4, that is to say it is plugged onto the upright pointed bars 28, 28*a* and 28*b*, so that the longer, diagonally opposite outer pointed bars 28*a* and 28*b* are bent around and the filter element 6 is therefore temporarily fixed. The filter element is thus fed to the shield housing in a simple manner from the connection side or rear. At this point, the ferrite core configuration is plugged or threaded onto the plug pins 5. Subsequently, the shield housing 4 is pushed onto the strip body 1, or the latter is plugged into the shield housing, which automatically latches on the strip body in the manner described, by means of the spring arms 29 which are disposed in the base surface 25 of the shield housing 4. A dip-soldering process is then carried out, during which the plug pins 5 are soldered in the holes 15 in the filter element 6 in one operation, and the ground connections are made between the pointed bars 28, 28*a*, 28*b* and the associated holes 13. After soldering, the plug pins 5 are bent at right angles.

This assembly sequence can be carried out in a particularly cost-effective manner.

We claim:

1. A filter plug connector, comprising:

a strip body being formed of insulating material and having a front with latching devices, a rear and side walls;

a ferrite core configuration having holes formed therein;

a chamber being formed by said strip body, having an open rear for receiving said ferrite core configuration and having a base;

a number of parallel plug pins being disposed in a grid, entering said chamber from the rear and emerging through said base of said chamber to the front of said strip body, at least some of said plug pins being guided in said chamber by said holes in said ferrite core configuration;

a shield housing covering said side walls and at least part of the rear of said strip body and of said chamber, said shield housing having a cut out formed therein for said plug pins, having resilient side parts engaging over said side walls of said strip body, having bends on said side parts latching onto said latching devices on the front of said strip body, and having an outer surface;

a capacitive filter element for receiving a number of said plug pins, said filter element being soldered to said plug pins and to said shield housing at said outer surface of said shield housing opposite said rear of said chamber;

said bends on said resilient side parts of said shield housing being mutually separate and mutually parallel individual spring arms, said spring arms having a section being bent inwards from said side parts approximately at right angles and a section being bent outwards from said inward bent section at an angle less than 180° to form a radius, said inward bent section forming a sliding and latching element, and said outward bent section forming a contact element for said shield housing to make contact with a mounting panel; and said side walls of said strip body being tapered towards the open rear of said chamber at least over a subregion extending in a plugging direction, forming lead-in and sliding inclines for said sliding and latching element to expand said side parts of said shield housing during connection of said shield housing and said strip body, and at least one of said sliding and latching elements having a latching device in the vicinity of said inward bent section for automatically latching said at least one sliding and latching element on said latching devices on the front of said strip body, with said latching device springing inwards after passing over said side walls of said strip body.

2. The filter plug connector according to claim 1, wherein said shield housing is a bent sheet-metal part being bent to be ready for use and ready for insertion.

3. The filter plug connector according to claim 1, wherein said side parts of said shield housing are mutually opposite, and an equal number of said spring arms are disposed on said mutually opposite side parts and are aligned with one another.

4. The filter plug connector according to claim 1, wherein said side parts of said shield housing are mutually opposite, and a different number of said spring arms are disposed on said mutually opposite side parts and are aligned with one another.

5. The filter plug connector according to claim 1, wherein said contact elements of said spring arms are longer than said sliding and latching elements.

6. The filter plug connector according to claim 1, wherein said contact elements of said spring arms have free ends and are domed in the vicinity of said free ends.

7. The filter plug connector according to claim 1, wherein said shield housing has a base surface covering said open chamber formed by said strip body, said cut out formed in said shield housing is a centrally disposed, rectangular cut out in said base surface having two mutually opposite longitudinal sides and mutually parallel webs and pointed bars disposed on said two mutually opposite longitudinal sides, said webs and pointed bars initially lying in a plane and being directed towards one another in a developed projection of said shield housing.

8. The filter plug connector according to claim 7, wherein said webs are bent inwards to be inclined relative to said base surface for retention of said ferrite core configuration, and said pointed bars are bent outwards at right angles to said base surface for plugging said filter element on.

9. The filter plug connector according to claim 1, including other spring arms being disposed symmetrically relative to a center of said base surface of said shield housing covering said open chamber formed by said strip body, being drawn out of said base surface and being bent inwards to be inclined relative to said base surface.

10. The filter plug connector according to claim 1, wherein each of said side walls of said strip body has a respective and dedicated one of said lead-in and sliding inclines for a respective one of said spring arms of said shield housing.

11. The filter plug connector according to claim 1, wherein said side walls of said strip body have a given extent as seen in the plugging direction, and said side walls have said lead-in and sliding inclines over approximately two thirds of said given extent and have straight surfaces being parallel to the plugging direction over approximately one third of said given extent.

12. The filter plug connector according to claim 1, wherein said latching device of said sliding and latching elements is a latching hole, and said latching devices on the front of said strip body are projections.

13. The filter plug connector according to claim 1, wherein said latching devices include a dedicated latching device for each respective sliding and latching element of said spring arms being disposed on the front of said strip body.

14. The filter plug connector according to claim 1, including a printed circuit board base material on which said filter element is disposed.

* * * * *